United States Patent [19]

Hewell

[11] 4,432,170

[45] Feb. 21, 1984

[54] OUTDOOR TELEPHONE BOOTH

[75] Inventor: Gerald M. Hewell, Dewy Rose, Ga.

[73] Assignee: Royston Manufacturing Corporation, Royston, Ga.

[21] Appl. No.: 393,092

[22] Filed: Jun. 28, 1982

[51] Int. Cl.[3] ..... E04H 1/14

[52] U.S. Cl. ..... 52/28

[58] Field of Search ..... 52/28, 80; 362/148, 362/276; 312/223

[56] References Cited

U.S. PATENT DOCUMENTS

| | | | |
|---|---|---|---|
| 2,955,770 | 2/1960 | Sherron | 52/28 |
| 2,982,593 | 5/1961 | Chambers | 52/80 |
| 3,059,102 | 10/1962 | Sherron | 362/148 |
| 3,389,249 | 6/1968 | Rackley | 363/276 |

*Primary Examiner*—James L. Ridgill, Jr.

*Attorney, Agent, or Firm*—Howson and Howson

[57] ABSTRACT

This outdoor telephone booth has translucent side panels which extend substantially the full height of the booth. The side panels, and front and rear header panels as well as the interior of the booth are illuminated through a diffuser by a single source of illumination. The diffuser has a horizontal panel as well as two oblique side panels disposed at 30° with respect to the vertical for substantially uniform illumination of the full-height side panels of the booth. The sloping panels of the diffuser are held down by snap-in retainers, eliminating separate fasteners, and making the diffuser highly resistant to tampering. The illumination assembly depends from a bridge which extends across the upper end of the booth. The bridge is held down by a removable cover.

11 Claims, 4 Drawing Figures

OUTDOOR TELEPHONE BOOTH

BRIEF SUMMARY OF THE INVENTION

This invention relates to outdoor telephone booths of the type comprising a metal framework with transparent or semitransparent side panels and with a light source in the ceiling of the booth for illuminating the booth's interior as well as one or more distinctive signs in order to make the booth clearly visible and identifiable at night. The invention, while described with particular reference to a booth designed for mounting on a post or on a building wall, is applicable to a wide variety of telephone booth designs, including walk-in booths.

Outdoor telephone booths must be illuminated in such a way that they are clearly visible at night. Where they are located along highways in brightly lighted commercial areas, telephone booths must have a distinctive appearance so that they can be readily identified by motorists. A typical modern pole-mounted or wall-mounted telephone booth comprises a rear wall on which the telephone equipment is mounted, a pair of side walls, and a "header" which comprises three or four semitransparent panels at its upper end carrying the word "telephone" or appropriate symbols. A source of illumination within the header illuminates the header panels, and also illuminates the interior of the booth through a diffuser. In some booths, a semitransparent dome is provided above the header, which is also illuminated by the illumination source. Some of these booths have opaque side panels below the header. Others have transparent or semitransparent side panels. Still other booths of this general type have side panels which are a combination of opaque and transparent or semitransparent panels. In most cases, the side panels of the booth below the header are poorly illuminated, if at all. Except where a separate source of illumination is provided, the booth is visible from the side primarily by virtue of the illumination of the header side panels. However, as these header side panels are relatively small, in many cases they do not lend a sufficiently distinctive appearance to the booth to make it clearly identifiable in a lighted commercial area along a highway.

One object of this invention is to provide a telephone booth having a distinctive appearance by virtue of fully illuminated side panels using the same source of illumination which lights the interior of the booth. It is also an object of the invention to achieve substantially uniform illumination of a translucent side panel or at least to illuminate the side panel so that there is no visible transition between lighter and darker areas on the side panel. A further object of the invention is to provide a telephone booth which is distinctive in appearance by virtue of an illuminated side panel which extends substantially the full height of the booth.

The foregoing objects are achieved in accordance with the invention by providing translucent side panels which extend substantially the full height of the booth and illuminating the side panels through oblique portions of a diffuser through which the interior of the booth is illuminated. Visible transitions in the illumination of the side panels are avoided if the oblique portions of the diffuser are disposed at an angle between approximately 18° and approximately 60° from the vertical. Substantially uniform illumination of the side panels is achieved at an angle of about 30°.

Another object of the invention is to provide a tamper-resistant translucent diffuser having a horizontal bottom portion for illuminating the interior of the booth and oblique side portions for illuminating the full-height side panels of the booth. It is also an object of the invention to avoid the use of separate fasteners such as screws, rivets and the like for holding the translucent diffuser in place; to hold the diffuser securely in position for substantially uniform illumination of the side panels or at least for transition-free side panels illumination; and to simplify the telephone booth structure by providing for a unitary diffuser which is capable of illuminating both the interior of the booth and the side panels. These objects are achieved in accordance with the invention by a unitary translucent diffuser comprising a horizontal panel and with oblique panels formed along two of its opposite edges, and securing the diffuser in place by holding its horizontal portion down with bent tabs and holding its oblique portions in place by means of struck-out projections on triangular retainer elements, the struck-out projections permitting the diffuser to be snapped into place by applying pressure from above.

Still a further object of the invention is to provide a structurally simple but secure installation of a light fixture in a header having translucent panels on all four sides and having a diffuser comprising a horizontal portion below the light fixture and upwardly extending oblique portions on opposite sides of the light fixture. This object is achieved in accordance with the invention by providing a bridge structure for supporting the light fixture, and supporting the bridge in turn from structural elements on the upper edges of two opposite walls of the booth. In accordance with the invention, the bridge structure is desirably provided with hooks which rest on the structural elements and is held down by the header cover of the booth. No separate fasteners are required to secure the bridge structure in place. The only fasteners used are those which hold down the header cover.

Various other objects will be apparent from the following detailed description when read in conjunction with the drawings.

DETAILED DESCRIPTION

Figure 1:
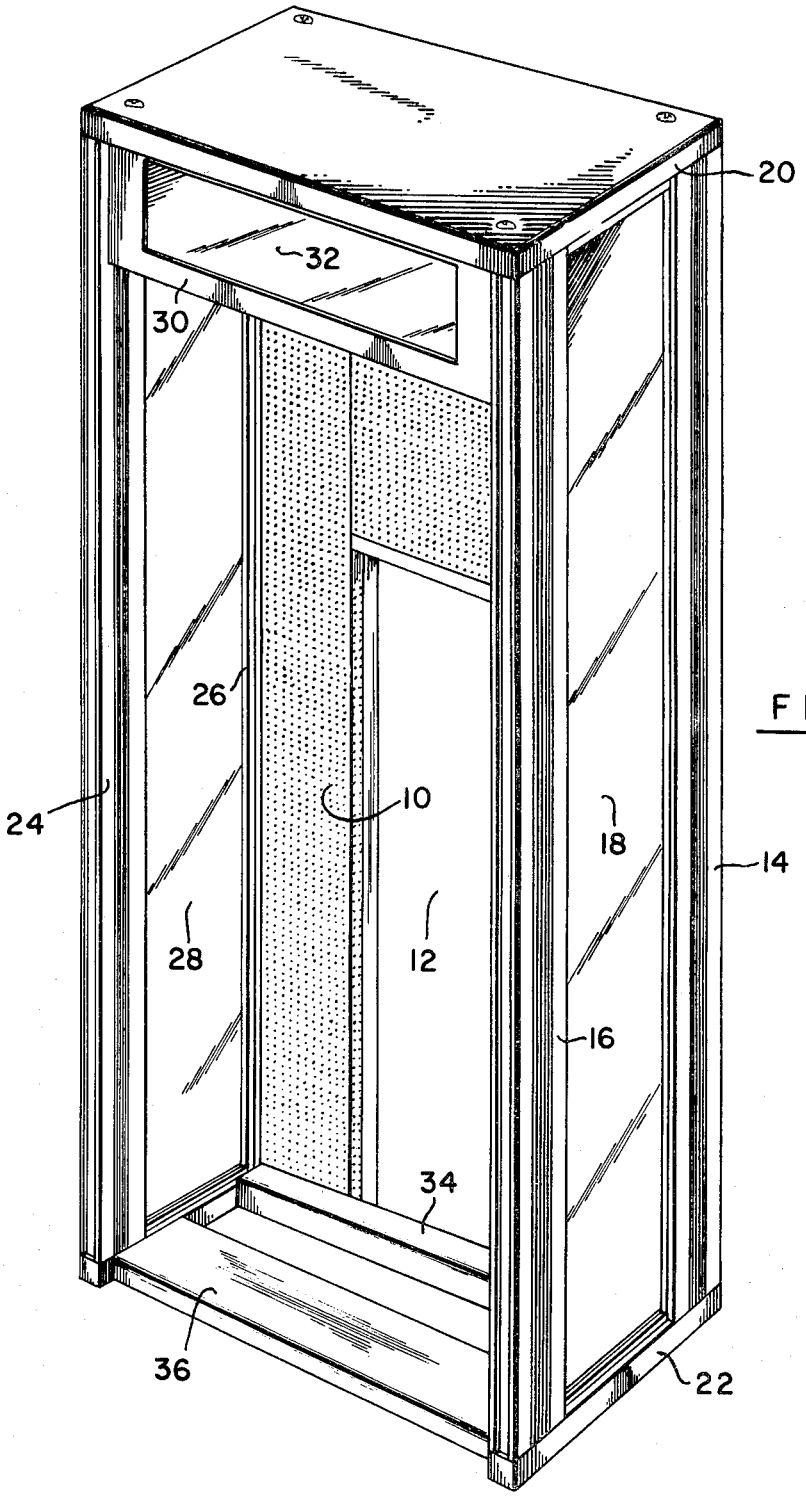
FIG. 1 is an oblique perspective view of a telephone booth in accordance with the invention.

The telephone booth of FIG. 1 is an outdoor telephone booth designed for post or wall mounting. The booth has a generally rectangular horizontal cross-sectional outline. It comprises a back wall 10 lined with perforated metal and having a vertically elongated rectangular opening 12 into which is fitted the telephone equipment. Extending substantially the full height of the booth at the right rear corner is an upright 14, which can be an aluminum extrusion. A similar upright 16 is provided at the front right corner of the booth. Between uprights 14 and 16 is mounted a translucent panel. (The term "translucent" is used herein in the broad sense to refer to transparent as well as semitransparent materials.) Typically, panel 18 is semitransparent, and carries a design such as the outline of a telephone handset. Because the panel extends substantially the full height of the booth, the design can be made quite large for optimum visibility. The panel is preferably made from a tough material such as polycarbonate.

The top cover of the booth is indicated at 20, and a horizontal member 22 extends between the lower ends of uprights 14 and 16 and provides support for panel 18 as well as a rigid structural connection between the uprights.

The left side of the booth is similarly constructed, and comprises uprights 24 and 26 with a translucent panel 28 between them.

The header 30 comprises a front header panel 32, and a similar rear header panel (not shown in FIG. 1) at the upper end of the rear wall. These front and rear header panels are preferably translucent polycarbonate, and may carry indicia such as the word "telephone" or appropriate symbols, or both. The rear header panel will normally be present on a post-mounted booth, but may be omitted in the case of a wall-mounted booth. Note that there are no translucent header panels on the sides of the booth corresponding to the front and rear header panels.

At the bottom of the rear wall of the booth a structural cross bar 34 is provided. This bar connects rear uprights 14 and 26, and also provides part of the structure by which the booth is connected to a mounting post or wall. A shelf 36 extends between structural member 22 and its counterpart at the left side of the booth. This shelf may have a telephone book support on its underside.

If the booth of FIG. 1 is mounted on a post, it is visible at night from the front by virtue of illumination through header panel 32 and from the rear by virtue of illumination through the corresponding rear header panel. It is visible from the sides by virtue of illumination of full-height side panels 18 and 28 by illuminating means to be described below.

The interior of the booth, the front and rear header panels, and the side panels are all illuminated by the same source of illumination, namely a fluorescent lamp located within the header structure.

Figure 2:
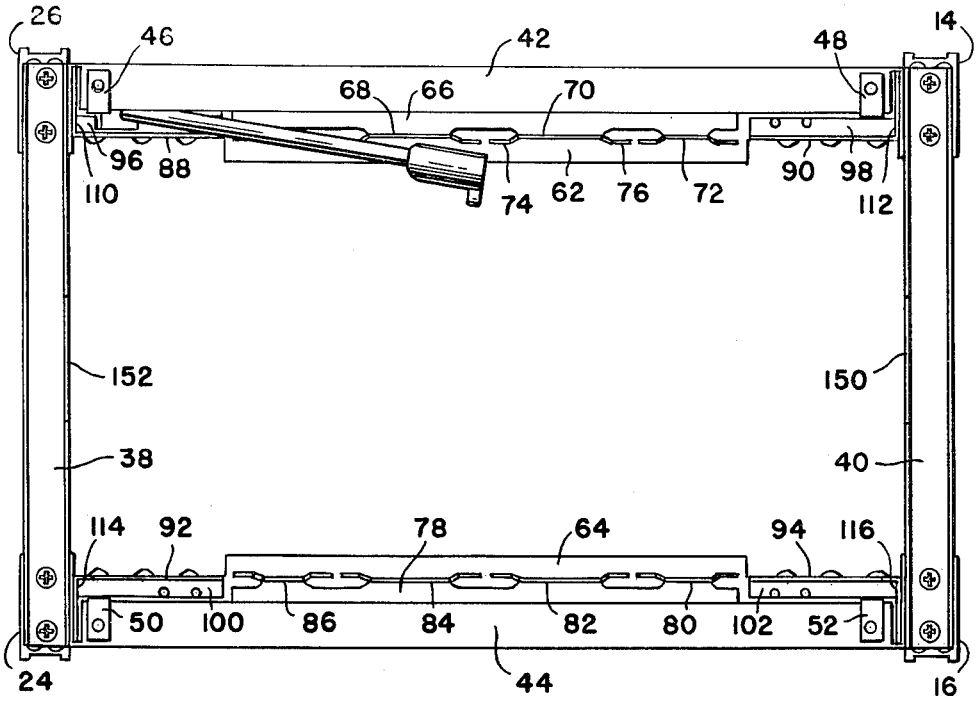
FIG. 2 is a top plan view of the booth with the cover, light fixture and diffuser removed.
Figure 3:
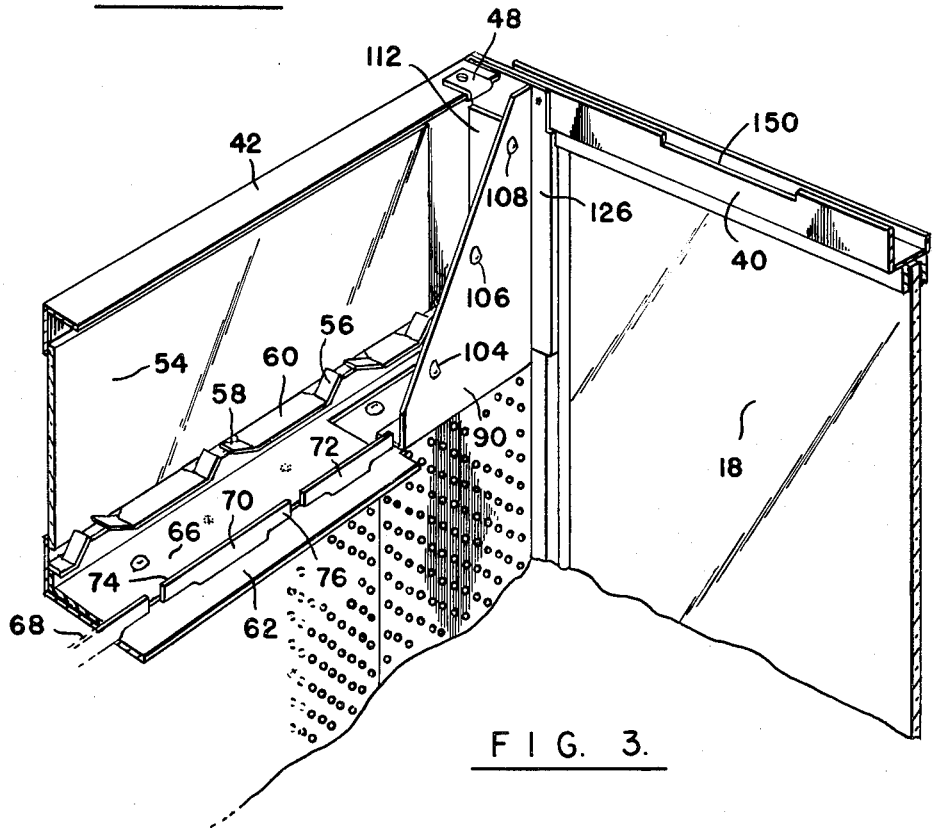
FIG. 3 is a fragmentary perspective view showing details of the diffuser hold-down means.

The details of the header structure are shown in FIGS. 2 and 3. In these figures, the illumination source and diffuser are omitted for better clarity.

FIG. 2 shows channels 38 and 40 which act as structural members at the upper ends of the side walls of the booth. Channel 38 connects the upper ends of uprights 24 and 26 together, while channel 40 connects the upper ends of uprights 14 and 16 together. Element 42 is a rear header panel frame, and element 44 is a front header panel frame. Clips 46 and 48 are mounted on the inwardly extending upper horizontal ledge of frame 42. These clips have threaded openings which receive hold-down screws for top 20 (see FIG. 1). Similar clips are shown at 50 and 52 on frame 44.

The rear translucent header panel 54 is held in frame 42 by tabs such as tabs 56 and 58 which are bent upwardly from retainer element 60. Similar retainer elements are provided along the lower edge and along the upper edge of the front and rear translucent header panels to hold the panels in place in frames 42 and 44. At the bottom of frame 42 is an inwardly extending ledge 62, and a similar inwardly extending ledge 64 is provided at the bottom of frame 44. These ledges serve as supports for the horizontal portion of the diffuser. As is best shown in FIG. 3, sheet 66 is secured to ledge 62. Retainer 60 and the other retainers at the lower edge of translucent rear header panel 54 are integral parts of sheet 66, as are retainers 68, 70 and 72. These latter retainers are similar to retainer 60, and serve to hold the horizontal portion of the diffuser down against ledge 62. Retainer 70 has tabs 74 and 76 which can be bent forwardly over the horizontal portion of the diffuser, and retainers 68, 70 and 72 have similar bendable tabs. On the front side of the booth, as shown in FIG. 2, there is provided a similar series of retainers which bendable tabs. These retainers are part of a metal sheet 78 which is secured to ledge 64 of frame 44. These retainers are indicated at 80, 82, 84 and 86.

In addition to the tabbed retainers for the horizontal portion of the diffuser, there are also provided at the corners of the booth four triangular diffuser retainers 88, 90, 92 and 94. Horizontally extending feet of these triangular retainers are indicated respectively at 96, 98, 100 and 102. These feet are spot welded to the ledges of the front and rear frames. Each triangular retainer has three D-shaped struck-out projections aligned along an angle of approximately 30° with respect to the vertical. The three projections of triangular retainer 90 are shown at 104, 106 and 108 in FIG. 3. These struck-out projections allow the oblique portions of the diffuser to be snapped into place, and hold these oblique portions of the diffuser securely in position without exposing any fasteners which might be subject to tampering.

In addition to feet 96, 98, 100 and 102, the triangular retainers also have vertically disposed flanges 110, 112, 114 and 116 which are secured by spot welding or by other suitable means to side elements of frames 42 and 44. Flange 112 of triangular retainer 90 is best seen in FIG. 3.

Figure 4:
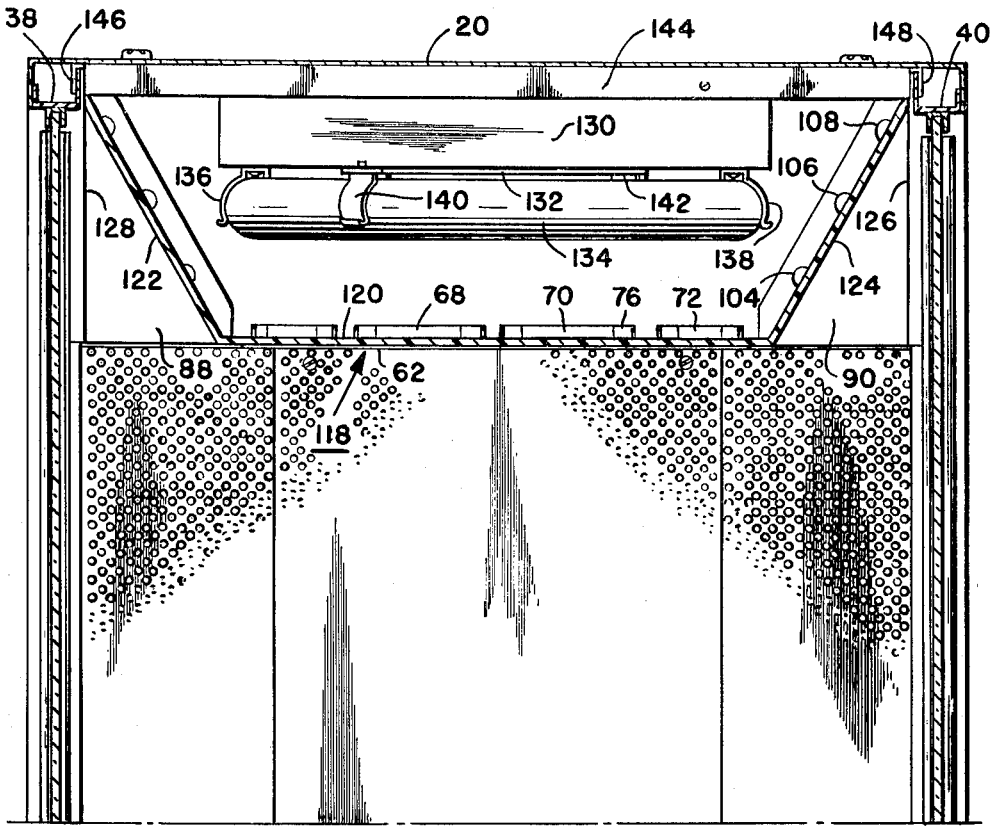
FIG. 4 is a vertical section of the upper part of the booth taken on a plane parallel to the back wall of the booth, showing the light fixture and the diffuser.

Diffuser 118 is shown in FIG. 4. It comprises a horizontal bottom portion 120, which is rectangular in shape, and oblique side portions 122 and 124, which are also preferably rectangular. Side portions 122 and 124 extend upwardly from the opposite edges of horizontal portion 120 of the diffuser, preferably at an angle of approximately 30° with respect to the vertical. These side portions of the diffuser are situated in oblique planes which intersect the planes of the vertical side panels of the booth along horizontal intersection lines.

In practice, substantially uniform illumination of the side panels of the booth can be achieved when the oblique portions of the diffuser are disposed at approximately 30°. The oblique portions of the diffuser, however, can be at any angle within the range of approximately 18° to approximately 60° with respect to the vertical. While substantial departures from 30° Will result in less uniformity in the illumination of the side panels, so long as the ange of the oblique portions of the diffuser is held within the range of approximately 18° to 60°, the illumination of the side panels will be generally acceptable, although it may not be strictly uniform. Departures from the range of approximately 18° to 60° will generally result in the appearance of visible transitions in the illumination along the vertical height of the side panels.

Diffuser 120 is preferably a semitransparent, tough plastic such as polycarbonate, and preferably formulated for resiliency so that it can be snapped into place over the D-shaped projections of the triangular retainers.

The diffuser does not have front and rear panels corresponding to sloping panels 122 and 124. The absence of front and rear sloping diffusers allows for direct illumination of the front and rear header panels of the booth.

As shown in FIG. 4, the rear edge of the horizontal portion 120 of the diffuser rests upon ledge 62, and the rear corners of the upper rear corners of the oblique portions 122 and 124 of the diffuser are held respectively against inwardly extending rear frame elements 128 and 126 by the D-shaped projections of retainers 88 and 90.

The illumination source for the booth comprises an electrical box 130, which contains a ballast device, a bracket 132, and a circular fluorescent lamp 134 supported by clips 136 and 138 on the electrical box and by clips 140 and 142 on bracket 132. Bracket 132 preferably extends obliquely with respect to the length of electrical box 130 as shown in FIG. 4 so that the illumination assembly can be more easily set in place without interference between clips 140 and 142 on the one hand and the upper edges of the front and rear header frames on the other.

Electrical box 130 is secured to the underside of a bridge 144, which is in the form of a metal channel having hooks 146 and 148 at its opposite ends. These hooks extend over recessed portions 150 and 152 (FIGS. 2 and 3) of channels 40 and 38. This positions lamp 134 directly above horizontal portion 120 of the diffuser and between oblique portions 122 and 124 of the diffuser approximately at the midpoint between their upper and lower edges. Cover 20 is held down by screws, and bears against bridge 144, holding it and the entire illumination means in place.

As will be apparent from FIG. 4, the interior of the booth is illuminated by the fluorescent lamp 134 primarily through horizontal portion 120 of the diffuser, while the full-height side panels of the booth are illuminated through oblique diffuser portions 122 and 124 respectively. The side panels of the booth are thus fully illuminated without the need for a source of illumination separate from that which illuminates the interior of the booth and the front and rear header panels. The single fluorescent lamp 134 provides all the illumination required. As the side panels are illuminated, and extend substantially the full height of the booth, the booth is highly visible and distinctive, even when located along highways in brightly lighted commercial areas.

As the diffuser is held down by bendable tabs and snap-in projections which are located entirely above the diffuser, it is securely held in position, and not readily tampered with.

The bridge greatly facilitates the mounting and replacement of the illumination means, particularly since the only fasteners which need to be removed for lamp replacement are the screws which hold cover 20 in place. The bridge also provides a convenient and effective solution to the mounting problem which results from the fact that the booth has translucent header panels on the front and rear of the illumination means, full-height side panels on both sides of the illumination means and oblique diffuser means between the illumination means and the side panels. The cooperation of hooks 146 and 148 at the ends of bridge 144 with notches 152 and 150 in channels 38 and 40 secures the bridge and the entire illumination assembly against lateral movement while allowing it to be removed easily for lamp replacement.

Various modifications can be made to the invention. Possible modifications include, but are not limited to, modifications in the exterior configuration of the booth, modifications in the diffuser, modifications in the diffuser hold-down means, and modifications in the support for the illumination means. For example, the invention is applicable to telephone booths of various different shapes and sizes, including not only pole-mounted and wall-mounted booths, but walk-in booths as well. While the diffuser is preferably a unitary plastic sheet having a horizontal portion and two oblique portions, the diffuser can consist of a horizontal element and two oblique elements separate from the horizontal element if suitable supports are provided. Modifications in the diffuser hold-down means may include various alternative bent-tab retainer configurations as well as various alternative configurations of snap-in projections. The light fixture support bridge preferably extends across the booth from one side panel to the other. However, it is possible to arrange the bridge so that it extends from the front header panel frame to the rear header panel frame. Various other modifications can be made without departing from the scope of the invention as defined in the following claims.

I claim:

1. A telephone booth comprising an enclosure having two vertically elongated translucent side panels extending uninterrupted substantially from the bottom to the top of the booth, a source of illumination located between said side panels near, but below, the top of the booth, and a semitransparent diffuser comprising a substantially horizontal panel located underneath said source of illumination, a first oblique panel located between said source of illumination and one of the two side panels, and a second oblique panel located between said source of illumination and the other of the two side panels, said oblique panels extending in a continuously oblique direction from said horizontal panel upwardly and outwardly toward said side panels.

2. A telephone booth according to claim 1 in which the oblique panels of the diffuser are unitary with the substantially horizontal panel of the diffuser.

3. A telephone booth according to claim 1 in which each of the oblique panels of the diffuser is disposed at an angle within the range of approximately 18° to 60° with respect to the vertical.

4. A telephone booth according to claim 1 in which at least one of the oblique panels of the diffuser is disposed at an angle of approximately 30° with respect to the vertical.

5. A telephone booth according to claim 1 in which each of the oblique panels of the diffuser is disposed at an angle of approximately 30° with respect to the vertical.

6. A telephone booth according to claim 1 in which the translucent side panels of the booth are situated in parallel substantially vertical planes and in which the oblique panels of the diffuser are situated in oblique planes which intersect said vertical planes along substantially horizontal lines.

7. A telephone booth according to claim 1 in which the oblique panels of the diffuser are unitary with the substantially horizontal panel of the diffuser and including means engaging the oblique edges of the oblique panels and preventing the oblique panels from bending toward each other about their intersections with the substantially horizontal diffuser panel.

8. A telephone booth according to claim 7 including ledge means located underneath the front and rear edges of the horizontal diffuser panel for supporting the horizontal diffuser panel against downward vertical movement, and means for securing the horizontal diffuser panel against upward vertical movement away from said ledge means.

9. A telephone booth according to claim 8 in which said means for securing the horizontal diffuser panel against upward vertical movement away from the ledge means comprises a series of retainers secured to said ledge means and having bendable tabs overlying the horizontal diffuser panel.

10. A telephone booth according to claim 7 in which the means engaging the oblique edges of the oblique panels comprises four fixed retainers, each retainer having an array of projections and each of the oblique edges of the oblique panels having one of the four retainers associated with it and being held against movement toward the opposite oblique panel by the projections on its associated retainer.

11. A telephone booth according to claim 10 in which at least the upper sides of said projections are rounded and in which said projections are sufficiently short to permit the oblique panels to be snapped into position during assembly of the booth.

* * * * *